US005842832A

United States Patent [19]

Thut

[11] Patent Number: 5,842,832

[45] **Date of Patent: *Dec. 1, 1998**

[54] PUMP FOR PUMPING MOLTEN METAL HAVING CLEANING AND REPAIR FEATURES

[76] Inventor: Bruno H. Thut, 16755 Park Circle Dr., Chagrin Falls, Ohio 44023-4598

[ * ] Notice: This patent issued on a continued prosecution application filed under 37 CFR 1.53(d), and is subject to the twenty year patent term provisions of 35 U.S.C. 154(a)(2).

[21] Appl. No.: 771,606

[22] Filed: Dec. 20, 1996

[51] Int. Cl.[6] ..... F04B 35/04

[52] U.S. Cl. ..... 417/53; 417/53; 417/360; 415/1; 415/200; 415/169.1; 266/235

[58] Field of Search ..... 417/360, 53, 424.1, 417/422; 266/235, 236, 239; 415/201, 1, 200, 169.1

[56] References Cited

U.S. PATENT DOCUMENTS

| | | | |
|---|---|---|---|
| 3,291,473 | 12/1966 | Sweeney et al. | 415/200 |
| 3,620,942 | 11/1971 | Day et al. | 204/68 |
| 3,984,234 | 10/1976 | Claxton et al. | 415/1 |
| 4,224,363 | 9/1980 | Veronesi et al. | 417/360 |
| 5,154,584 | 10/1992 | McEwen | 417/360 |
| 5,181,828 | 1/1993 | Gilbert et al. | 415/200 |
| 5,330,328 | 7/1994 | Cooper | 417/424.1 |
| 5,441,390 | 8/1995 | Rapp et al. | 417/424.1 |
| 5,676,520 | 10/1997 | Thut | 415/200 |

*Primary Examiner*—Charles G. Freay
*Attorney, Agent, or Firm*—Watts, Hoffmann, Fisher & Heinke Co., L.P.A.

[57] ABSTRACT

A pump for pumping molten metal includes a motor supported by motor mounting structure above a bath of the molten metal. A shaft has one end connected to the motor. An impeller is connected to the other end of the shaft. The motor mounting structure supports the motor above a bath of molten metal. A device connects the motor to the base member, facilitating replacement of the shaft. The pump may be cleaned by rotating the shaft in a shaft sleeve, the impeller being disposed in an impeller chamber of a base. The rotational velocity of the shaft is adjusted to approximate the velocity at which cavitation occurs in the pump. Metal oxides inside the shaft sleeve are then removed from the pump.

8 Claims, 2 Drawing Sheets

PUMP FOR PUMPING MOLTEN METAL HAVING CLEANING AND REPAIR FEATURES

FIELD OF THE INVENTION

The present invention is directed to pumps for pumping molten metal and, in particular, to pump cleaning as well as shaft and impeller replacement.

BACKGROUND OF THE INVENTION

Pumps for pumping molten metal typically include a motor bolted to a motor mounting structure. One end of a shaft is connected to the motor and another end is connected to an impeller. The pump may include a base having an impeller chamber in which the impeller is rotated. Support posts, a riser for transferring molten metal to another location and a shaft sleeve surrounding the shaft, may be disposed between the base and the motor mounting structure. Components of the pump subjected to the harsh molten metal environment are formed of a heat resistant material such as graphite.

Metal oxides commonly referred to as dross may collect on the surface of the molten metal bath. The dross tends to form a crust on the pump components. The crust can imbalance the shaft and accumulate on the inside of the shaft sleeve causing contact with the shaft, which leads to catastrophic failure of the shaft or the impeller. The dross is also abrasive and erodes the shaft as it rotates. In addition, foreign objects such as unmelted scrap and loose furnace bricks may become lodged in the base and damage the impeller.

The shaft and impeller require periodic replacement when damaged by the effects of the oxide crust and objects lodged in the pump. When replacing the shaft and impeller, the pump is hoisted out of the pump well to a location where a worker using protective gloves can disconnect the shaft from the motor. The shaft is removed from the bottom of the base which can be hazardous to the worker, as he may be severely burned by molten metal dripping from the pump.

This method of shaft replacement is disadvantageous since the pump must be removed from the well. For example, when removing the shaft and impeller of a transfer pump, which pumps molten metal upwardly through a riser to another location, the pump must be disconnected from transfer piping by removing pipe clamps. Therefore, replacing the shaft and impeller results in significant down time of pumps.

SUMMARY OF THE INVENTION

The present invention relates to pumps for pumping molten metal and, in particular, to pumps that facilitate shaft and impeller replacement as well as pumps that are self-cleaning. The shaft of the pump may be cleaned and replaced without removing the pump from the molten metal.

In general, the present invention is directed to a pump for pumping molten metal including a motor supported above a molten metal bath by a motor mounting structure. One end of a shaft is connected to the motor and another end of the shaft is connected to an impeller. The pump may also include a pump base having an impeller chamber for receiving the impeller and a shaft sleeve surrounding the shaft between the motor mounting structure and the pump base. The motor mounting structure includes a base member for supporting the motor above the molten metal bath and a device for moving the motor away from a location of alignment with the shaft preferably by pivoting, which facilitates replacement of the shaft and impeller.

More specifically, the device includes at least one pin about which the motor is pivoted. The device may include at least one leg and at least one upstanding foot member extending from the base member. One end of the leg is connected to the foot member and the other end is connected to the motor. One of the leg and the foot member carries the pin and the other of the leg and the foot member has an opening for receiving the pin. A replacement impeller is preferably connected to the replacement shaft and both the replacement shaft and the replacement impeller are preferably unused. Reference to "replacement" shaft or impeller herein means that the component is a replacement for the component previously used in the pump.

The motor mount of the present invention permits the shaft and impeller to be replaced in a safe and efficient manner. The legs on one side of the motor may be bolted to the base member. The legs on the other side of the motor are pivotably mounted to at least one pin carried by the foot members, so that the motor mount can be easily moved away from the base member opening. The shaft and impeller thus can be removed while the pump is disposed in the molten metal. The pump need not be disconnected from any transfer piping and, since it is not removed, it need not undergo gradual reintroduction into the molten metal. This increases the efficiency of the pumping process. In addition, workers need only lift the shaft upwardly from the pump, which reduces the time workers spend near the hot pump and the molten metal. Since the shaft is lifted upwardly from the pump, the hazardous condition of burns caused by molten metal dripping from the pump is eliminated.

In general form, a method of replacing a shaft of a pump for pumping molten metal includes the step of disconnecting the shaft from the motor. The motor is moved from an aligned position over the shaft to another position away from the shaft. The shaft is removed from the pump and a replacement shaft is inserted into the pump. The motor is moved back to the aligned position and the replacement shaft is connected to the motor.

In preferred form, the present method of shaft or impeller replacement includes disconnecting the shaft from the motor while the motor is supported over the molten metal bath. The motor is pivoted on at least one of the legs from an aligned position over the base member opening to another position away from the base member opening. The shaft is lifted from the molten metal bath through the base member opening and a replacement shaft is lowered through the base member opening into the bath. The motor is pivoted back to the aligned position and the replacement shaft is connected to the motor. At least one of the legs may be releasably fastened to the base member.

Another embodiment of the invention is directed to a method of cleaning a pump for pumping molten metal while the shaft is rotated in molten metal in the shaft sleeve and the impeller is disposed in the impeller chamber. The rotational velocity of the shaft is adjusted to a cleaning velocity approximating a shaft rotational velocity at which cavitation occurs in the pump. The pump is preferably cleaned by rotating the shaft at a velocity below the velocity at cavitation. Metal oxides on the surface of the molten metal inside the shaft sleeve are then removed from the pump. This method inhibits accumulation of the oxide crust on the shaft and on the inside of the shaft sleeve, thereby reducing shaft and impeller damage.

A preferred embodiment of the cleaning method includes the step of rotating the shaft at a cleaning rotational velocity $u_c$ above a rotational velocity $u_n$ at which the shaft can be rotated during normal pumping of the molten metal. The pump is preferably operated at the cleaning rotational velocity after the pump is operated at the normal rotational velocity. The pump is operated at the cleaning rotational velocity for a time sufficient to remove metal oxides and crust formed on the interior pump components such as on the shaft and the inside of the shaft sleeve. The pump is preferably operated at the cleaning velocity for about 10 to about 30 seconds for each hour of operation of the pump at the normal rotational velocity. The level of molten metal inside the shaft sleeve is preferably located near the inlet openings of the shaft sleeve adjacent the base when the shaft is rotated at the cleaning rotational velocity. After cleaning, the pump may resume normal operation.

Other embodiments of the invention are contemplated to provide particular features and structural variants of the basic elements. The specific embodiments referred to as well as possible variations and the various features and advantages of the invention will become better understood from the accompanying drawings, together in connection with the detailed description that follows.

DETAILED DESCRIPTION OF THE PREFERRED EMBODIMENTS

Figure 1:
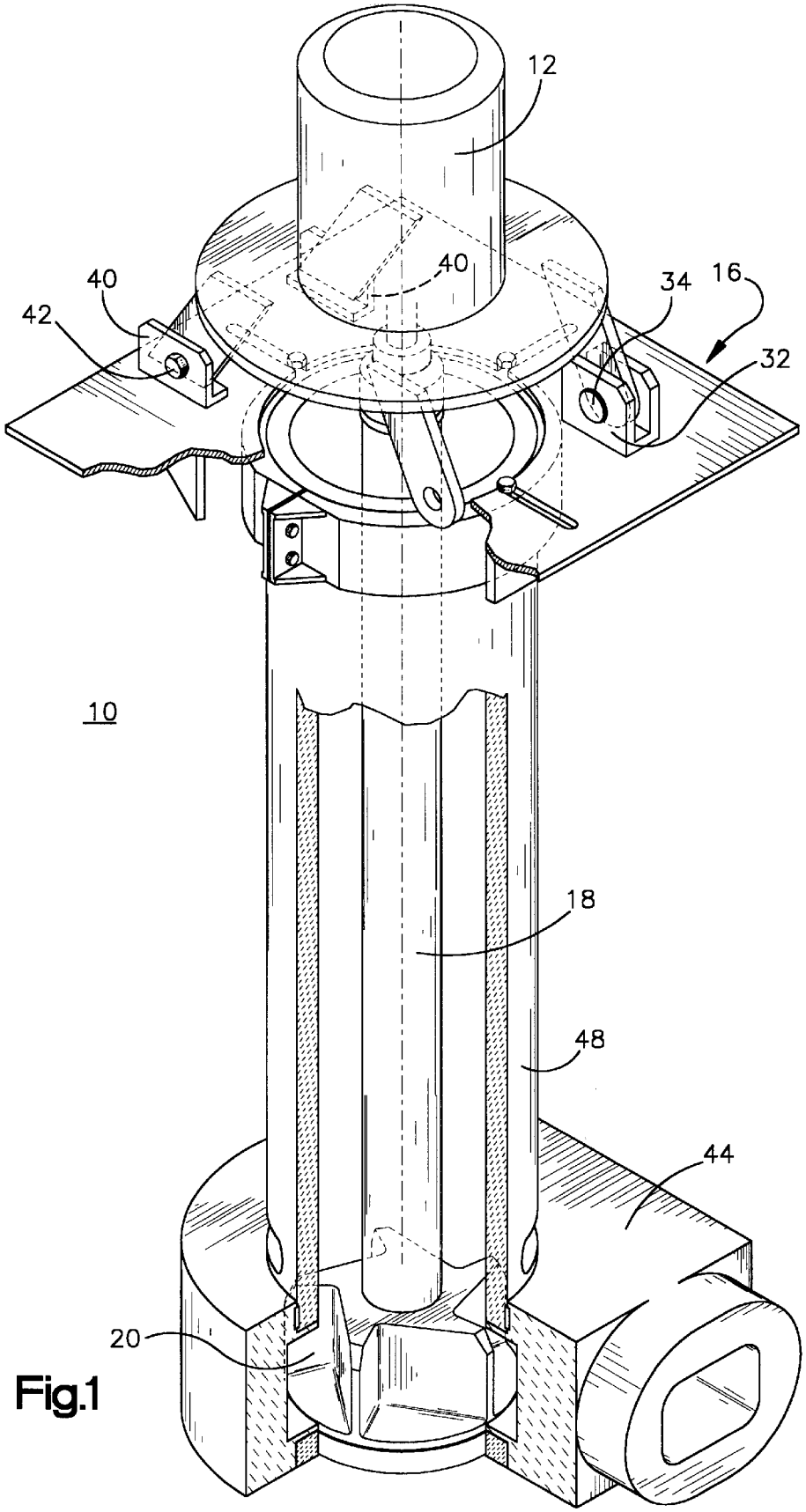
FIG. 1 is a perspective, partial cross-sectional view of a pump for pumping molten metal employing a motor mounting structure constructed in accordance with the present invention.
Figure 2:
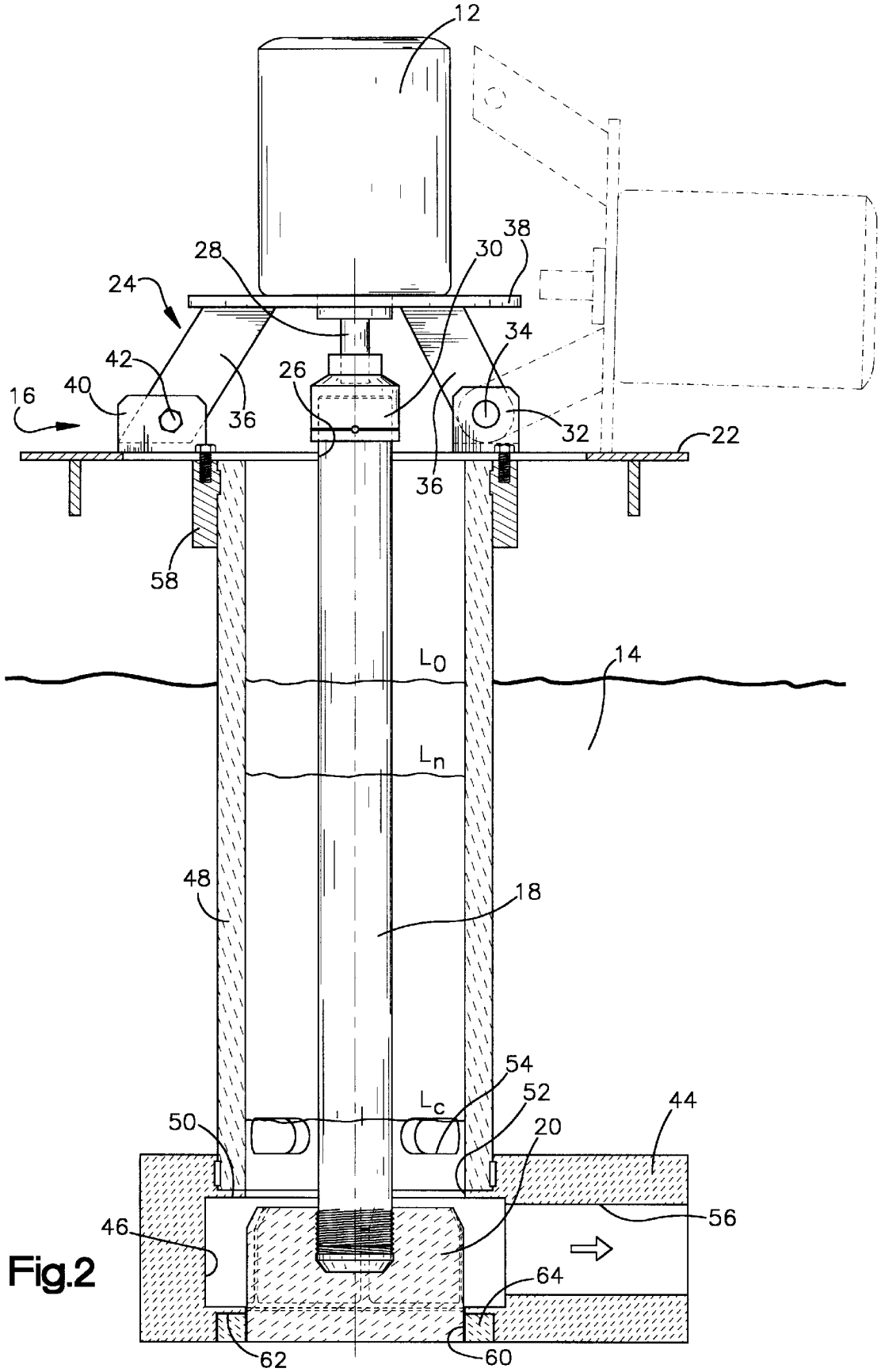
FIG. 2 is a vertical cross-sectional view of the pump of FIG. 1.

Referring now to the drawings, FIGS. 1 and 2 illustrate a pump for pumping molten metal designated generally at 10. The pump 10 includes a motor 12 supported above a molten metal bath 14 by a motor mounting structure or motor mount 16. The motor may be an air or electric motor. The molten metal may be zinc, aluminum or alloys thereof. A shaft 18 has one end connected to the motor and another end connected to an impeller 20. The motor mount 16 comprises a base member preferably in the form of a plate 22, and a device 24 for pivotally mounting the motor to the plate 22. The motor mount facilitates safe and efficient replacement of the shaft and impeller without having to remove the pump from the molten metal bath.

The base plate 22 includes an opening 26 through which the shaft and a drive shaft 28 of the motor may be connected. The shaft is coupled to the drive shaft using any coupling device 30 such as a universal joint. The shaft is preferably connected to the drive shaft using the coupling device disclosed in U.S. Pat. No. 5,622,481, entitled Shaft Coupling for a Molten Metal Pump, which is incorporated herein by reference in its entirety.

The device 24 includes preferably two foot members 32 each carrying at least one clevis pin 34 and at least one leg 36 that is pivotably fastened to the base plate 22 by the foot members 32. In a preferred arrangement, four legs 36 are employed. Each leg that is received by one of the foot members 32 has an opening for receiving the pin. Each foot member 32 is preferably a U-shaped clevis member that carries the clevis pin (FIG. 1). For clarity, only one of the two clevis members 32 is shown in FIG. 1. A plate 38 is supported by the upper ends of the legs, the motor being fastened to the plate 38.

On the other side of the motor mount, two legs are each fastened to a foot member 40. The foot members 40 are preferably L-shaped as shown in FIG. 1. A bolt 42 passes through an opening in each of the foot members 40 and into a threaded opening in each of the legs 36 for releasably fastening the legs to the base plate 22. The foot members 32, 40 are integrally formed with, welded or otherwise fastened to the base plate 22.

The device 24 may be any device that enables the motor to be moved from an alignment position over the base plate opening to another position away from the base plate opening, while the motor is at least partially fastened to the base plate. For example, the motor may be slidably fastened to the base plate. Moreover, although use of the illustrated device 24 is preferred, the motor may be directly supported on the base plate without the leg members and may be pivotally connected to the plate member 22 by having a portion of the motor receive at least one clevis member and pin. The motor mount components are preferably comprised of steel.

A hanger bracket (not shown) is preferably connected to the motor mount. The hanger bracket may include an eye to which a chain of a hoist may be hooked for raising and lowering the pump from and into the pump well. If no hanger bracket is used, the eye may be disposed directly on the housing of the motor.

The pump is hoisted into position over the pump well and lowered into the well to leave, for example, about 2–4 inches of space between the bottom of the impeller and the floor of the well. The pump is preferably bolted to support structure (not shown) extending horizontally over the pump well, in a manner known to those skilled in the art.

The pump preferably includes a base 44 having an impeller chamber 46 in which the impeller is rotated. The impeller chamber may include an optional volute member (not shown). The pump may include support posts and a tubular riser, in the case of a transfer pump, located between the pump base and the motor mount. A shaft sleeve 48 preferably surrounds the shaft between the motor mount and the pump base and is cemented in place on a shoulder 50 around an inlet 52 of the base. The shaft sleeve has inlet openings 54 preferably disposed near the top of the base.

In the particular top feed discharge pump shown, the base includes an outlet passageway 56 leading, for example, to a scrap charging well. However, those skilled in the art will appreciate that the pivotable motor mount feature, as well as the self-cleaning feature of the invention described hereafter, can be used with all pumps for pumping molten metal including circulation pumps, transfer pumps and discharge pumps.

The shaft sleeve, as well as any support posts and riser, may be secured to the pump and to the motor mount in any manner known to those skilled in the art. It is preferred to secure these components to the motor mount using the quick release clamp 58 disclosed in U.S. Pat. No. 5,716,195, entitled Pumps for Pumping Molten Metal, which is incorporated herein by reference in its entirety.

The pump base 44 also includes an opening 60 opposite to the inlet opening, in which the impeller is partially disposed. The base may employ a shoulder 62 around the opening 60 on which a bearing ring 64 is cemented. The impeller may include at least one bearing ring. A preferred impeller for use in the present invention is the five-bladed impeller disclosed in U.S. Pat. No. 5,597,289, entitled Dynamically Balanced Pump Impeller, which is incorporated herein by reference in its entirety.

A method of replacing the shaft and the impeller, such as when either of these components is damaged, includes the step of deactivating the motor to stop rotation of the shaft. The shaft is then disconnected from the motor, preferably and advantageously while the pump is disposed within the molten metal bath 14. A worker carefully disconnects the shaft from the drive shaft using protective, heat resistant gloves. The shaft and impeller may be lowered from the motor to rest on the floor of the pump well.

The bolts 42 that releasably fasten the legs to each foot 40 are removed. The motor and the plate 38 are then pivoted on the legs 36 from an aligned position over the base plate opening 26 to another shaft removal position away from the base plate opening. In the shaft removal position, the motor, the plate and the legs are disposed in the position shown by dotted lines in FIG. 2, out of the vertical path of alignment with the shaft. The shaft and impeller are then lifted vertically from the shaft sleeve through the base plate opening and are removed from the pump.

Although a replacement shaft along with a replacement impeller are preferably inserted into the pump, if either the shaft or the impeller is undamaged, it can be reinserted into the pump. However, in view of the rapid deterioration of the components in the harsh environment of the molten metal bath, unused components are preferably used as replacements. The shaft and impeller are replaced as needed, for example, about once every four weeks.

The replacement shaft and impeller are lowered through the base plate opening down into the shaft sleeve, and the impeller is positioned in the impeller chamber. The replacement shaft is then connected to the drive shaft. The pump may now resume normal operation.

In a self-cleaning operation of the present invention, the pump may be cleaned without having to be removed from the molten metal bath. The cleaning operation is preferably conducted when pumping molten aluminum and alloys thereof. As shown in FIG. 2, when the shaft in the shaft sleeve is not rotated, the level of molten metal in the shaft sleeve $L_o$ is at the level of molten metal outside the shaft sleeve. During normal operation of the pump, the shaft is rotated at a normal rotational velocity $u_n$. At the normal rotational velocity, the molten metal in the shaft sleeve is located at a level $l_n$, which is lower than the level $l_o$, for example, by about 3 or 4 inches. Those skilled in the art will appreciate that the molten metal levels shown in FIG. 2 are intended only as approximate levels and may vary, for example, with different pumps and pumping conditions.

While not wanting to be bound by theory, during normal operation of the pump, a pressure differential $\Delta P$ or negative pressure is created in the pump due to rotation of the impeller, which tends to draw the molten metal through the shaft sleeve inlet openings into the impeller chamber. During normal operation of the pump the pressure differential $\Delta P$ is less than a pressure differential $\Delta P_D$, which is the difference in pressure of the molten metal at the shaft sleeve inlet openings with respect to the pressure of the molten metal at the surface of the bath.

To establish a point of reference, the velocity of the shaft is preferably increased to the point of cavitation in the pump. At cavitation, the molten metal level is located near the impeller chamber. The shaft velocity is then reduced somewhat from the cavitation velocity to a cleaning rotational velocity $u_c$.

The cleaning rotational velocity is greater than the normal rotational velocity $u_n$, and is preferably the closest lesser velocity at which cavitation no longer occurs. Although cleaning may be conducted while cavitation occurs, this risks damaging the shaft and the impeller. As an example, with appreciation that conditions may vary due to factors including the sizes of pump components and the distance between the shaft sleeve inlet openings and the surface of the bath, a normal rotational velocity of a shaft of one pump was about 600 rpm. Cavitation occurred at about 900 rpm and the cleaning velocity was a lesser velocity at which cavitation no longer occurred.

Rotating the shaft at the cleaning rotational velocity raises the molten metal level in the pump from the level at cavitation. At the cleaning rotational velocity the molten metal is in the shaft sleeve at the level $l_c$, which is lower than the normal molten metal level $l_n$, for example, by about a foot. The molten metal cleaning level $l_c$ may be approximately the depth of the inlet openings.

At the cleaning molten metal level $l_c$, the pump draws the metal oxides disposed on the surface of the molten metal from inside the shaft sleeve and out of the pump. This prevents the metal oxides from forming a crust on the inside of the shaft sleeve. In addition, any crust formed on the pump components, such as on the inside of the shaft sleeve and on the shaft, is removed. As a result, there is no oxide crust to interfere with rotation of the shaft.

The pump is operated at the cleaning rotational velocity for a time sufficient to remove the dross from the surface of the molten metal in the shaft sleeve and to remove any crust that has formed on the pump components, in particular, on the shaft. The pump is preferably operated at the cleaning rotational velocity for about 10 to 30 seconds for each hour of operation at the normal rotational velocity. Cleaning most preferably lasts about 10 seconds. After cleaning, normal operation is resumed, the shaft being rotated at the normal rotational velocity $u_n$.

While not wanting to be bound by theory, during the cleaning operation the pressure differential $\Delta P$ inside the shaft sleeve is believed to approximate the pressure differential $\Delta P_D$ outside the pump. During cleaning, the pressure differential $\Delta P$ is preferably less than the outside pressure differential $\Delta P_D$. The magnitude of the difference between $\Delta P_D$ and $\Delta P$ is less during the cleaning operation than during normal operation. To avoid cavitation during cleaning as is preferable, $\Delta P$ should not exceed $\Delta P_D$.

The molten metal level in the shaft sleeve may be affected by the size of the inlet openings 54. As the size of the inlet openings is decreased, the molten metal level in the shaft sleeve decreases. The inlet opening size may be reduced as long as it does not undesirably reduce the rate of pumping. The lower molten metal level may result in less dross collecting on the shaft sleeve during normal operation compared to a shaft sleeve having larger inlet openings. In addition, the lower molten metal level in the shaft sleeve may result in a lesser rotational velocity being needed for cleaning.

Although the invention has been described in its preferred form with a certain degree of particularity, it will be understood that the present disclosure of the preferred embodiments has been made only by way of example and that various changes may be resorted to without departing from the true spirit and scope of the invention as hereafter claimed.

What is claimed is:

1. A method of cleaning a pump for pumping molten metal, comprising the steps of:

rotating a shaft of the pump in molten metal in a shaft sleeve surrounding the shaft, an impeller of the pump being disposed on an end of the shaft in an impeller chamber of a base;

adjusting the rotational velocity of the shaft to a cleaning velocity approximating a rotational velocity of the shaft at which cavitation occurs in the pump; and removing metal oxides inside the shaft sleeve from the pump.

2. The method of claim 1 wherein a level of molten metal inside the shaft sleeve is near inlet openings of the shaft sleeve adjacent the base when the shaft is rotated at said cleaning velocity.

3. The method of claim 1 wherein the metal oxides removed from the shaft sleeve are disposed near the surface of the molten metal in the shaft sleeve.

4. The method of claim 1 wherein molten metal enters the shaft sleeve through at least one inlet opening in the shaft sleeve adjacent the base, the size of the inlet opening being selected to lower a level of molten metal in the shaft sleeve.

5. The method of claim 1 wherein the cleaning velocity is less than the velocity at cavitation.

6. A method of cleaning a pump for pumping molten metal, comprising the steps of:

rotating a shaft of the pump in molten metal in a shaft sleeve surrounding the shaft, an impeller of the pump being disposed on an end of the shaft in an impeller chamber of a base;

rotating the shaft at a cleaning rotational velocity $u_c$ above a rotational velocity $u_n$ at which the shaft can be rotated during normal pumping of the molten metal, the cleaning rotational velocity approximating a rotational velocity of the shaft at which cavitation occurs in the pump; and removing metal oxides inside the shaft sleeve from the pump.

7. The method of claim 6 wherein the pump is operated at the normal rotational velocity $u_n$ before being operated at the cleaning rotational velocity $u_c$.

8. The method of claim 6 wherein the pump is operated at the cleaning rotational velocity $u_c$ for about 10 to about 30 seconds for each hour of operation of the pump at the normal rotational velocity $u_n$.

* * * * *